US005901917A

United States Patent [19]

Schmidt et al.

[11] Patent Number: 5,901,917

[45] Date of Patent: May 11, 1999

[54] AIR-POWERED WEB SLASHER

[75] Inventors: Francis E. Schmidt, Appleton; Robert C Weber, Depere, both of Wis.

[73] Assignee: Valmet Inc., Appleton, Wis.

[21] Appl. No.: 09/053,534

[22] Filed: Apr. 1, 1998

[51] Int. Cl.[6] ..... B65H 35/10

[52] U.S. Cl. ..... 242/521; 242/524.1; 242/526.1

[58] Field of Search ..... 242/521, 526, 242/527, 527.3, 527.6, 523.1, 524, 524.1, 526.1; 83/597, 599, 663

[56] References Cited

U.S. PATENT DOCUMENTS

| | | | |
|---|---|---|---|
| 3,049,311 | 8/1962 | Birch, Jr. . | |
| 3,845,914 | 11/1974 | Straujups . | |
| 4,552,316 | 11/1985 | Dropczynski et al. | 242/521 |
| 5,346,151 | 9/1994 | Zimmerman et al. | 242/521 |
| 5,377,930 | 1/1995 | Noyes | 242/521 |
| 5,810,279 | 9/1998 | Rodriguez et al. | 242/521 |

*Primary Examiner*—Donald P. Walsh
*Assistant Examiner*—William A. Rivera
*Attorney, Agent, or Firm*—Rudnick & Wolfe

[57] ABSTRACT

An air-powered web slasher features a cylindrical housing having an interior chamber and a sidewall with a spiral groove machined into it. A piston slides within the interior chamber and has a slasher needle attached to it. The slasher needle protrudes through the spiral groove. A housing cap covers one end of the housing and pressurized air is supplied to the portion of the interior chamber between the housing cap and the piston so that the piston travels away from the housing cap. As a result, the needle travels along the spiral groove and thus up into and through a web of material, such as paper, to create a slash in the cross-machine direction. A turnup blow pipe provides air to the slasher. In addition, slits in the turnup blow pipe direct streams of air against the web in proximity to the slash so that the web is severed. The air streams then blow the newly severed end of the web onto an empty rotating spool. A compression spring positioned between the piston and the slasher housing bottom returns the piston and needle to their initial positions when the flow of air to the slasher is terminated.

17 Claims, 4 Drawing Sheets

AIR-POWERED WEB SLASHER

BACKGROUND OF THE INVENTION

The invention relates generally to devices for cutting a web of material as it is being wound onto a roll and, more particularly, to a device that slashes and tears the web to create a free end that is thereafter blown onto an empty core or spool so that the web material may be wound continuously.

Flexible sheet materials, such as paper, are often produced as continuous sheets or "webs" by lines of machinery. When a line of papermaking machinery is initially activated, such as at the beginning of a work shift, adjustments must be made before the resulting web of paper is of acceptable quality. These adjustments consume a considerable amount of time and effort. In addition, a significant amount of papermaking material is wasted as the adjustments are fine-tuned. As a result, it is desirable to run a papermaking line continuously once it is fully adjusted.

Paper webs are typically wound upon a roll at the end of the papermaking line for storage or to await further finishing work. As the web of paper is continuously drawn off of the end of the papermaking machine line and wound about the roll, the size of the roll will increase until it becomes necessary to begin a new roll. To avoid machinery readjustments and the disadvantages associated therewith, it is desirable to cut the paper web and feed the resulting free end onto an empty core or spool without stopping or slowing the papermaking line. Various devices and arrangements have been proposed to accomplish such a function.

Blades are frequently used to cut paper webs. These blades may have a length extending over the entire cross-machine width of the web, or, alternatively, a short knife may be used that is moved transversely across the width of the web. An example of the latter is the device disclosed in U.S. Pat. No. 3,365,992 to Dreher. Dreher shows a carriage assembly with a short knife pivotally mounted to its bottom and an adhesive sprayer positioned on its top. The carriage is mounted upon cross-machine spanning rails so that it may travel across the width of the web. This allows the knife to cut the web. As the knife is cutting the web, adhesive is sprayed upon an adjacent empty spool. As a result, the web is wound about the spool as the newly-cut portion contacts the sprayed adhesive.

While the device of Dreher is effective, it requires the use of adhesive to feed the web onto a spool. This is an additional material cost. Furthermore, the web is actually cut obliquely due to the web's continuous movement as the knife travels across it. This results in greater paper waste. The cross-web travel of the knife also limits the speed at which the device may be operated. An additional disadvantage to Dreher is that the knife blade must occasionally be sharpened. This translates into increased maintenance requirements. Features such as the moving carriage mechanism and the adhesive spray nozzles add to the bulkiness and complexity of the device and thus also increase maintenance and space requirements.

A device utilizing a cross-machine length blade is shown in U.S. Pat. No. 3,049,311 to Birch. The Birch device features a bottom-hinged curved grating mounted upon a hydraulic cylinder that is positioned beneath the exit side of a driving roller. The grating is elevated in a direction perpendicular to web travel when the hydraulic cylinder is activated. A cutting blade is positioned across the top of the grating so that the web is cut when the grating is elevated. A number of small rollers are positioned near the top of the grating so that the newly cut web is wrapped about a spool positioned above the driving roller as the grating is further elevated.

While this device overcomes the cost of using adhesive and does not produce as much waste as the device of Dreher, it is still mechanically complex and bulky. In addition, the cutting blade would require periodic sharpening. As a result, the device of Birch would also suffer from significant maintenance and space requirements. Furthermore, the bulk of the device would make high-speed operation difficult.

Devices have also been developed that utilize jets of air to lap a severed web onto an empty spool. An example of such a device is presented in U.S. Pat. No. 3,845,914 to Straujups. Straujups uses a chain-cutting mechanism that spans the width of the web. This mechanism is powered by an electric motor and cuts the web from below as it is elevated via a hydraulic cylinder. A series of air jets are positioned across the cutting mechanism. This allows the severed end of the web to be blown or "air lapped" onto a waiting spool as the mechanism is elevated beyond the cutting position.

While Straujups eliminates the additional material costs and some of the complexity of earlier lapping arrangements, the cutting mechanism is still bulky and mechanically complex. The cutting chain requires periodic sharpening and lubrication and the hydraulic cylinder has maintenance requirements. The electric motor powering the cutting chain would also consume energy and occasionally require servicing or replacement. The bulk of the cutting portion would once again make high-speed operation difficult.

Turnup blow pipes, or gooseneck turnups, have long been used in the paper manufacturing industry to lap the free end of a paper web about a spool. A primary advantage of turnup blow pipes is their compactness and simplicity. These devices typically consist of a pipe positioned in a primarily vertical orientation. The pipe features an opening at its top end and is connected to a source of pressurized air. The top portion of the pipe is angled slightly so that a stream of air travels through the opening in a direction tangential to the spool. Turnup blow pipes are typically oriented below the spool and downstream from the driving roller of the papermaking line.

While turnup blow pipes have proven to be an effective means of lapping paper about a spool, attempts to use the devices as cutters have been less successful. More specifically, the air streams produced by the devices have thus far been found to be suitable only for cutting and tearing very thin grades of paper. This is because a very high air pressure is required to initially burst through the web to start the tear. After this initial burst, however, a lower air pressure will suffice in completing the tear. Most turnup blow pipes do not provide sufficient air pressure to reliably perform the initial bursting function.

If a turnup blow pipe featured a device that would allow it to make a more direct or "positive" initial burst, that is, more of an initial mechanical slash, it could be used to cut thicker grades of paper, or other materials without the use of very high air pressure. Such a device would drastically increase the utility of turnup blow pipes.

Accordingly, it is an object of the present invention to provide a web cutting and lapping device that allows for continuous and high-speed operation of the web-producing machinery.

It is another object of the present invention to provide a web cutting and lapping device that does not utilize knives or blades.

It is another object of the present invention to provide a web cutting and lapping device that is relatively compact.

It is another object of the present invention to provide a web cutting and lapping device that possesses simple construction and low maintenance requirements.

It is still another object of the present invention to provide a web cutting and lapping device that does not use adhesives and that minimizes paper waste.

It is still another object of the present invention to provide a web cutting and lapping device that provides for a positive initial slashing of the web.

It is still another object of the present invention to provide a web cutting and lapping device that may incorporate existing turnup blow pipes.

SUMMARY OF THE INVENTION

The present invention is directed to an air-powered web slasher that slashes a web of material, such as paper, and blows it onto an empty spool. The present invention accomplishes this function as the material is continuously drawn off of the end of a manufacturing line.

The slasher features a cylindrical housing that defines an interior chamber. The sidewall of the housing has a spiral groove machined through it. A piston is disposed within the interior chamber and is sized so that it may slide up and down. A slasher needle is attached to the piston and protrudes through the spiral groove in the housing sidewall. A housing cap covers one end of the housing. Pressurized air is fed to the portion of the interior chamber between the housing cap and the piston so that the piston is forced to move away from the housing cap. As the piston moves, the slasher needle travels along the spiral groove so that it moves up into and through the web of material creating a slash in the cross-machine direction. A compression spring positioned between the piston and the slasher housing bottom returns the piston and slasher needle to their original positions when the supply of air is terminated.

The slasher housing is mounted on top of a turnup blow pipe. The turnup blow pipe provides air to the slasher housing and also features a number of slits directing streams of air at the web, in proximity to the slash created by the slashing needle. As a result, tears propagate away from the slash so that the web severs. The newly severed end of the web is then blown by the air streams onto an empty rotating spool. A plurality of slasher/blow pipe assemblies are preferably used together so that wider webs may be severed.

The following detailed description of embodiments of the invention, taken in conjunction with the appended claims and accompanying drawings, provide a more complete understanding of the nature and scope of the invention.

DESCRIPTION OF THE PREFERRED EMBODIMENTS

Figure 1:
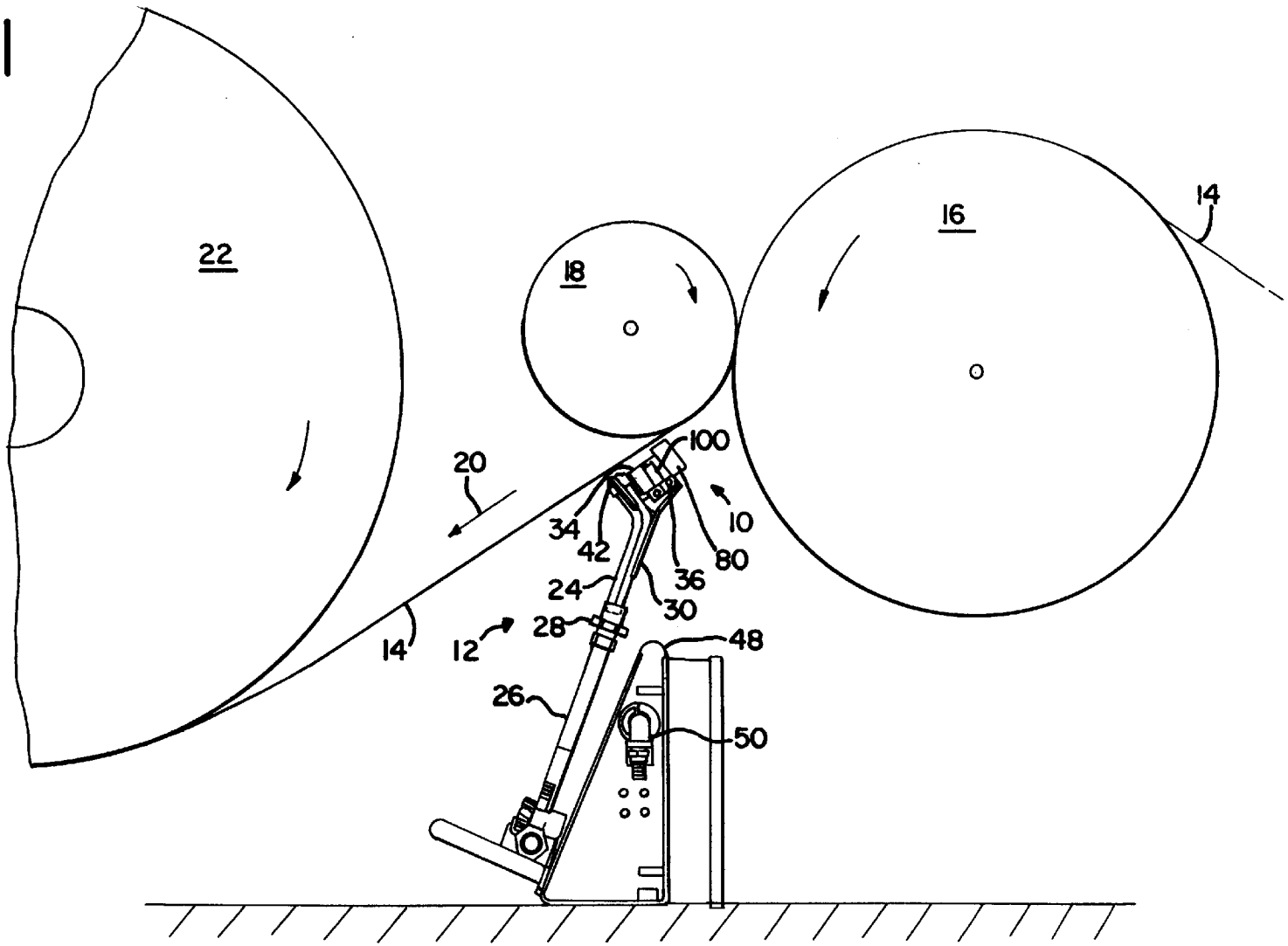
FIG. 1 is a side elevational view of an embodiment of the air-powered web slasher of the present invention mounted upon a turnup blow pipe at the end of a papermaking line.

With reference to FIG. 1, an embodiment of the air-powered web slasher of the present invention is indicated generally at 10. As shown in FIG. 1, the air-powered web slasher 10 is mounted to the top of a turnup blow pipe, indicated generally at 12. Both the slasher 10 and the turnup blow pipe 12 are positioned beneath a web of paper, indicated at 14. While the air-powered slasher of the present invention will be described herein as used in a papermaking operation, it is to be understood that it may be used with other materials in other industries as well. Furthermore, the slasher 10 could be used separate from the blow pipe 12 and could be powered by a fluid other than air (such as water).

As is known in the papermaking industry, a reel drum 16 is powered by a high-output motor to rotate in a counterclockwise direction so as to pull the web of paper 14 from a spreader roll (not shown) at the end of a papermaking line. Reel drum 16 directs the web through the nip formed between itself and an empty steel spool, indicated at 18. After passing through the nip, the web travels in the direction indicated by arrow 20 so as to be wound about a paper roll, indicated at 22. Paper roll 22 is powered by a motor so as to rotate in a clockwise direction.

Figure 2:
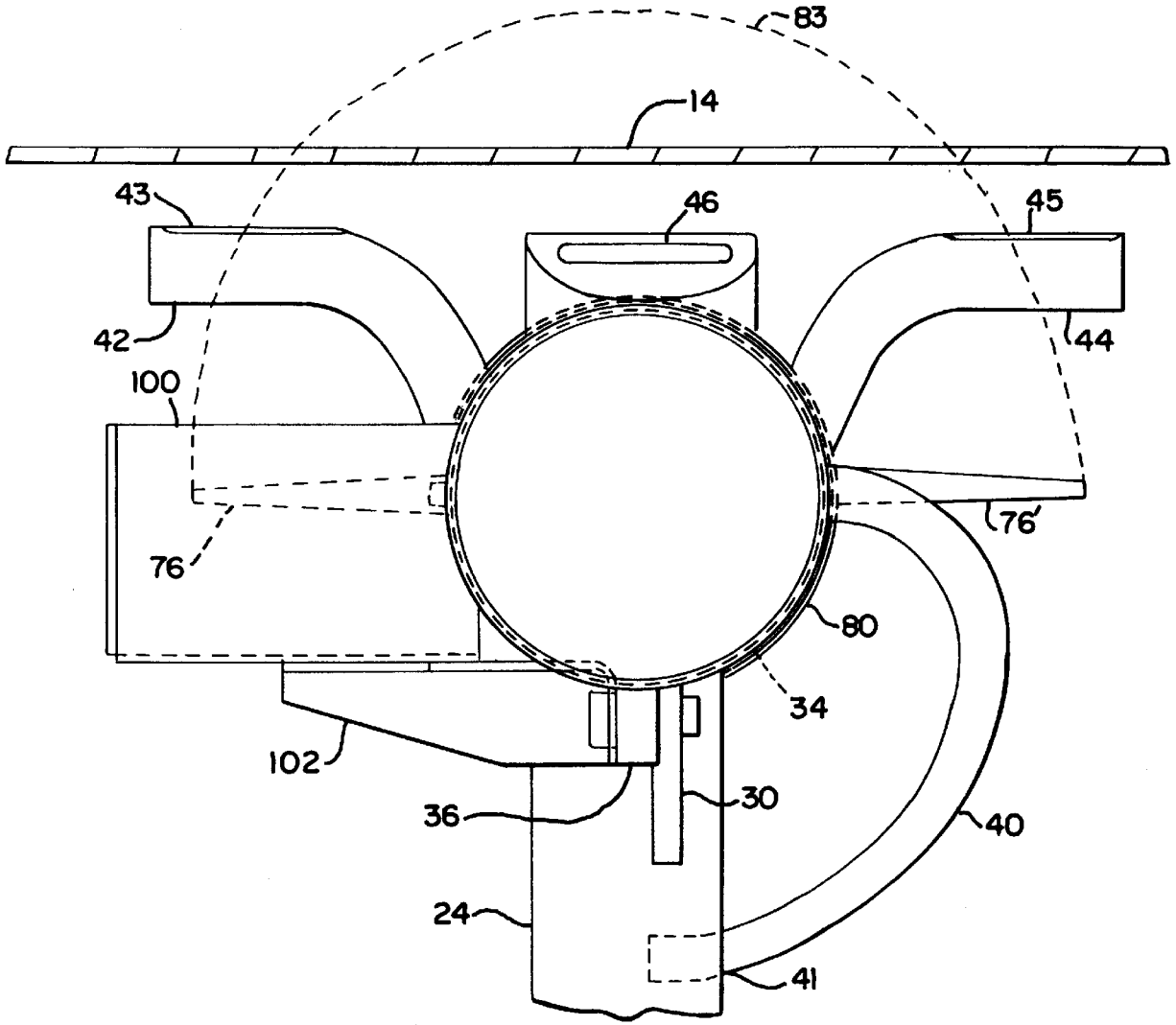
FIG. 2 is a top plan view of the air-powered web slasher of FIG. 1 taken parallel to the direction of web travel.
Figure 3:
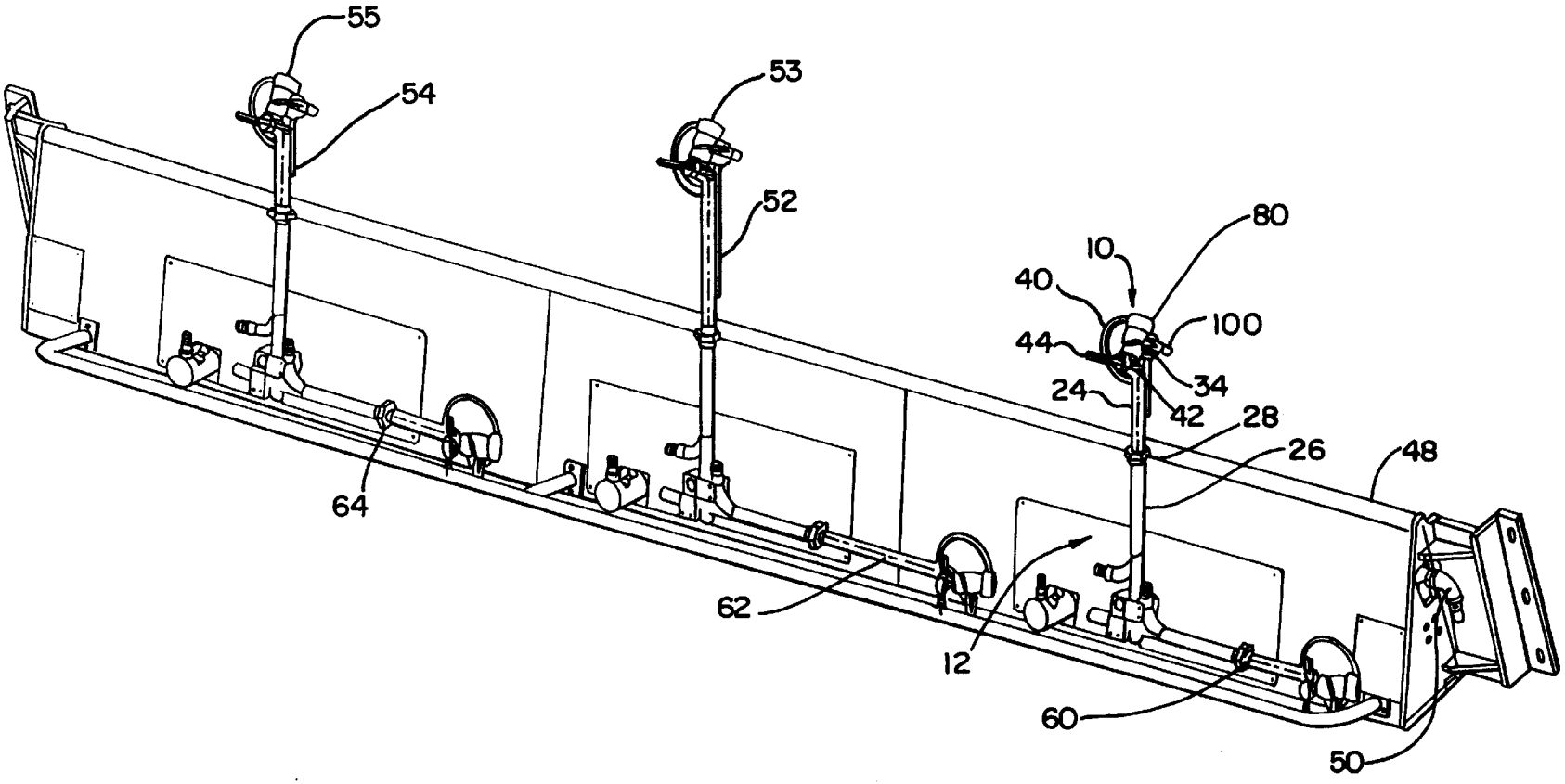
FIG. 3 is a perspective view of three air-powered web slashers of the type shown in FIG. 1 mounted upon turnup blow pipes and a base manifold.

Turnup blow pipe 12 features an upper portion 24 and a lower portion 26 releasably connected by a releasable joining member 28. A bracket, indicated at 30 is welded to upper portion 24. The slasher housing, indicated at 34, features a flange 36 that is bolted to bracket 30. Referring to FIGS. 2 and 3, tubing 40 runs between the top of slasher housing 34 and a port 41 formed in the upper portion 24 of the turnup blow pipe so that slasher 10 and blow pipe 12 are in fluid communication. Tubing 40 may be constructed of materials such as steel or plastic. Existing turnup blow pipes may thus be retrofitted with the slasher of the present invention merely by substituting an upper portion that has been modified to include a bracket 30 and an appropriate port.

A pair of auxiliary conduits, indicated at 42 and 44 in FIG. 2, project out from the upper portion 24 of the turnup blow pipe. The conduits feature auxiliary slits 43 and 45 along their lengths. In addition, a slit, indicated at 46, is formed through the top end of upper portion 24. All three of these slits communicate with the interior of the turnup blow pipe so that they produce streams of air. Upper portion 24 features a bend so that the slasher 10 and the air streams from slits 43, 45 and 46 approach web 14 at the appropriate angle. Releasable joining member 28 (FIG. 3) permits upper portions 24 of varying lengths to be swapped for one another so that different spool sizes may be accommodated.

As shown in FIG. 3, the lower portion 26 of the turnup blow pipe is mounted upon a base manifold, indicated at 48. Additional blow pipes, indicated at 52 and 54, are preferably mounted in an equal-spaced relationship across the width of base manifold 48 so that their slashers, indicated at 53 and 55, respectively, traverse the paper web in a cross-machine direction. Base manifold 48 receives pressurized air from a source (not shown) through pipe 50 and distributes it to each of the blow pipe/slasher assemblies. Suitable sources of pressurized air, such as pumps or tanks, are well known in the industry. As indicated at 60, 62 and 64, each blow pipe/slasher assembly may be withdrawn from the base manifold 48 and stored in a sideways configuration so that the base manifold 48 may be transported, maintenance may be performed or the overhead rollers may be shifted.

Figure 4:
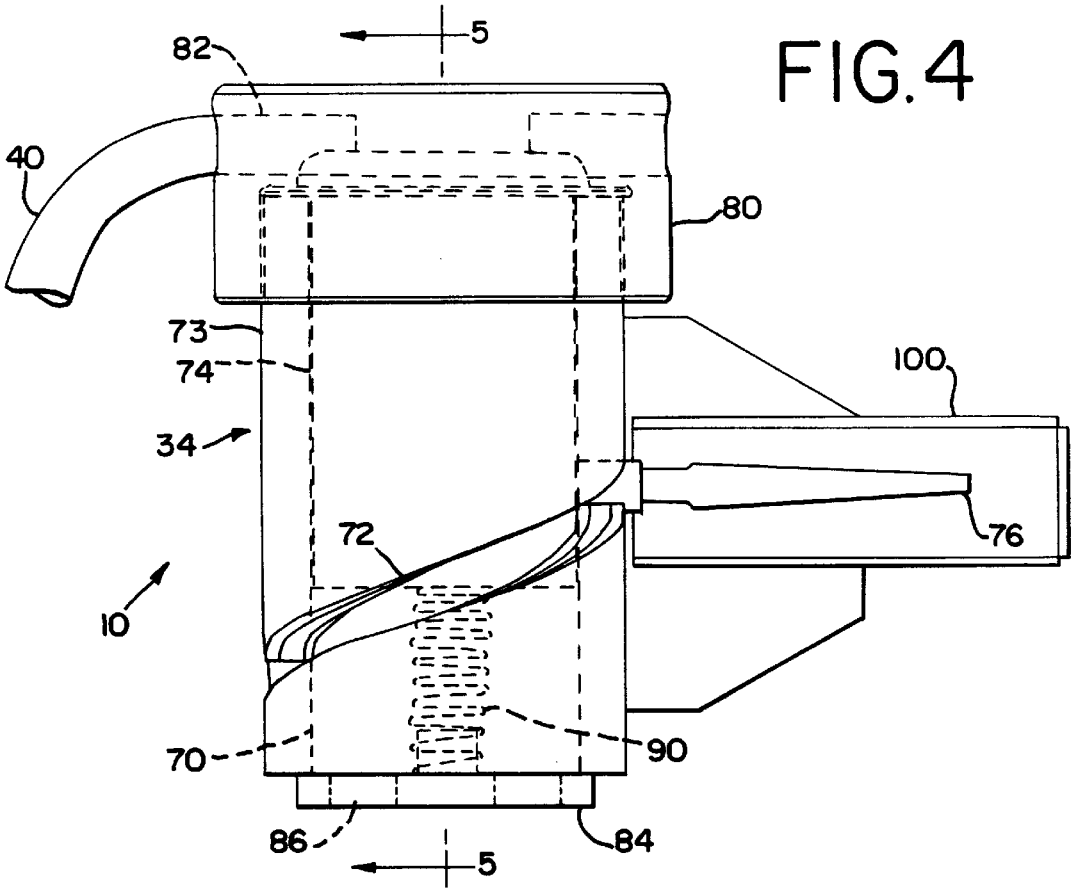
FIG. 4 is an enlarged, front elevational view of the air-powered web slasher of FIG. 1 showing a portion of its interior in phantom.

Referring to FIG. 4, an enlarged frontal view of slasher 10 is shown. Slasher 10 features a slasher housing 34 that encloses a cylindrically-shaped interior chamber 70. A spiral groove 72 is machined into the sidewall 73 of housing 34. A slasher piston 74 is disposed within housing 34 and is sized so that it may slide within chamber 70. A slasher needle, indicated at 76, is screwed or press-fitted into piston 74 for movement therewith and protrudes through spiral groove 72.

A housing cap, 80, is screwed or press-fitted onto the top end of housing 34. A passageway, indicated in phantom at 82, is drilled through cap 80 so that pressurized air from tubing 40 may selectively enter the top portion of chamber 70. When this occurs, piston 74 is forced downwards and needle 76 travels through spiral groove 72. Referring to FIG. 2, as needle 76 travels through the spiral groove, it rotates approximately 185° through a path illustrated by dashed line 83 to a position indicated at 76'. The bottom 84 of housing 34 features a number of holes, indicated at 86 in FIGS. 4 and 5, that allow air to escape from the bottom portion of chamber 70 as piston 74 travels downward. The downward travel of piston 74 is halted when it contacts the slasher housing bottom 84.

Figure 5:
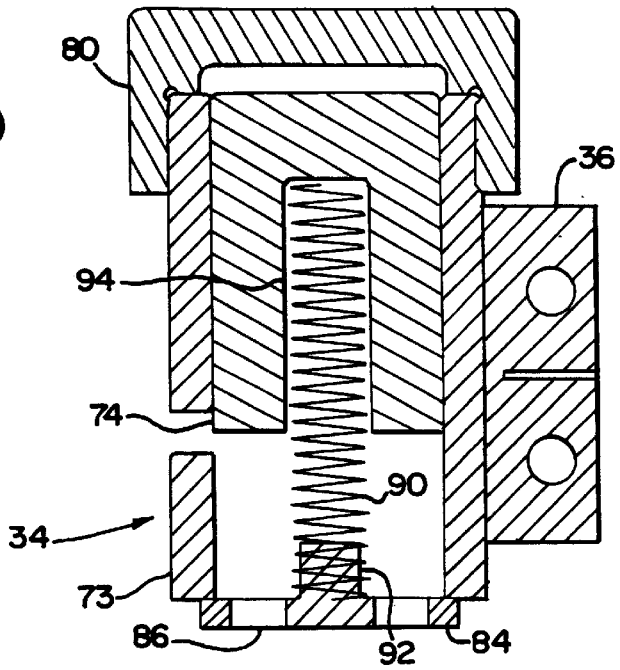
FIG. 5 is a sectional view of the air-powered web slasher of FIG. 4 taken along line 5—5.

A compression spring, illustrated at 90 in FIGS. 4 and 5, is disposed between piston 74 and housing bottom 84. The bottom portion of spring 90 engages a tab 92 formed on the interior surface of housing bottom 84 while the top portion of spring 90 is received by a central recess 94 formed in piston 74. As a result, when the flow of air from tube 40 is halted, piston 74 returns to its initial position, illustrated in FIGS. 4 and 5.

As shown in FIG. 2, a needle guard 100 is attached (either by bolts or welds) via needle guard bracket 102 to housing flange 36. Needle guard 100 is positioned so that it encloses slasher needle 76 when the latter is in its initial position, as illustrated in FIGS. 3 and 4.

Returning to FIG. 1, the operation of the web slasher of the present invention with respect to reel drum 16, empty spool 18 and paper roll 22 will be explained. As stated above, the web of paper 14 is pulled from the end of a papermaking line by reel drum 16, which is powered to turn in a counterclockwise direction. After passing over reel drum 16, the web 14 is wound about paper roll 22, which is powered to turn in a clockwise direction. As paper roll 22 reaches its maximum size, web 14 must be cut and fed onto empty spool 18. This must be accomplished while web 14 is continuously drawn off of the end of the papermaking line so that readjustment of the papermaking machinery, and the associated waste of resources, may be avoided.

As the time for cutting web 14 nears, an empty steel spool 18 is lowered into the position shown in FIG. 1. In this initial position, steel spool 18 makes slight contact with reel drum 16, with web 14 sandwiched in between, so that the spool is turned in a clockwise direction. Upon being so positioned, spool 18 is ready to receive a severed end of web 14.

Pressurized air is next provided to the base manifold 48 through pipe 50. It has been found that an individual blow pipe/slasher assembly requires an air pressure of about 150 psi for proper operation. Base manifold 48 distributes air at the appropriate pressure to blow pipe 12 as well as to blow pipes 52 and 54 (FIG. 3). Pressurized air received by blow pipe 12 travels through tubing 40 (FIGS. 2 and 3) so as to activate slasher 10. As a result, slasher needle 76, as shown in FIG. 2 by dashed line 83, exits the needle guard 100 and very rapidly sweeps into and through web 14 causing a slash in the cross-machine direction, that is, perpendicular to the movement of web 14. Slashers 53 and 55 of FIG. 3 operate in the same manner to create similar slashes that are aligned in the cross-machine direction with the slash created by slasher 10.

As slashers 10, 53 and 55 are performing their function, air streams exit slits 43, 45 and 46 in slasher 10 (FIG. 2) and similar slits in blow pipes 52 and 54. These air streams are directed against web 14 in proximity to the locations of the slashes created by slashers 10, 53 and 55. As a result, tears in web 14 propagate away from the slashes in a cross-machine direction so that web 14 is severed.

The air streams from blow pipes 12, 52 and 54 blow the newly severed end of paper web 14 up onto rotating spool 18. As a result, web 14 is wound about spool 18 so that a new paper roll is begun. After this "turnup" is completed, the air flow into base manifold 48 is terminated and the compression spring (90 in FIGS. 4 and 5) forces the slasher needle back to its initial position within needle guard 100. The nearly instantaneous operation of the slasher needles combined with the simultaneous production of air streams, allows the web to be severed and fed onto the empty spool 18 very quickly so that the papermaking line does not have to be slowed.

As spool 18 accumulates paper, it is gradually moved away from reel drum 16 (towards the left in FIG. 1). As this occurs, a motor powering spool 18 is activated so that spool 18 continues to rotate in a clockwise direction after it loses contact with reel drum 16. Spool 18 eventually reaches the position occupied by paper roll 22 in FIG. 1 where paper web 14 continues to accumulate until the paper roll about spool 18, reaches a maximum size. At that time, a new spool is lowered into the position occupied by spool 18 in FIG. 1 and the above process is repeated.

While the preferred embodiments of the invention have been shown and described, it will be apparent to those skilled in the art that changes and modifications may be made therein without departing from the spirit of the invention, the scope of which is defined by the appended claims.

What is claimed is:

1. An apparatus for slashing a web of material comprising:

a) a cylindrical housing having a spiral groove in the sidewall thereof;

b) a piston disposed within said housing for reciprocal movement between first and second positions;

c) a slasher needle attached to said piston, said needle protruding through said groove so that said needle travels along said groove as said piston moves in said housing between said first and second positions; and d) means for moving said piston between said first and second positions whereby said needle contacts said web to slash it.

2. The apparatus of claim 1 wherein said means for moving includes:

a) a source of pressurized fluid to move said piston from said first position to said second position; and b) biasing means to return said piston to said first position.

3. The apparatus of claim 2 wherein said biasing means is a spring.

4. The apparatus of claim 1 further comprising a needle guard for enclosing said needle when said piston is in said first position.

5. The apparatus of claim 1 wherein said means for moving said piston includes:

a) a turnup blow pipe having a slit therethrough, said blow pipe receiving pressurized air so that an air stream flows through said slit;

b) a tube for communicating a portion of said pressurized air from the blow pipe to said housing to move said piston between said first and second positions; and c) means for supplying the pressurized air to said blow pipe.

6. The apparatus of claim 5 wherein said means for supplying the pressurized air to said blow pipe includes a base manifold.

7. The apparatus of claim 5 further comprising an auxiliary conduit attached to and in communication with said blow pipe, said auxiliary conduit having an auxiliary slit therethrough so that air from said blow pipe blows through the auxiliary slit and produces an additional air stream.

8. The apparatus of claim 5 wherein said turnup blow pipe features an upper portion and a lower portion that are removably connected by a releasable joining member.

9. The apparatus of claim 1 wherein the material is paper.

10. An apparatus for slashing a web of material and blowing it onto a spool comprising:

a) a cylindrical housing defining an interior chamber and having a sidewall with a spiral groove therethrough;

b) a piston disposed within said interior chamber for sliding between first and second positions;

c) a slasher needle attached to said piston and protruding through said groove so that said needle travels along said groove as said piston moves in said interior chamber between said first and second positions;

d) a turnup blow pipe with a slit therethrough supporting said housing, said housing and said slit positioned proximate to the web;

e) a tube in communication between said blow pipe and said interior chamber; and f) means for selectively pressurizing said blow pipe; whereby when pressurized air enters said blow pipe, it simultaneously flows through said slit to create an air stream and into said interior chamber so that said piston is forced to slide from said first position to said second position so that said slasher needle travels along said groove and creates a slash in the web, said air stream blowing on the web so that the web is torn and blown onto said spool.

11. The apparatus of claim 10 further comprising a biasing means to return said piston to said first position.

12. The apparatus of claim 11 wherein said biasing means is a compression spring.

13. The apparatus of claim 10 further comprising a needle guard for enclosing said needle when said piston is in said first position.

14. The apparatus of claim 10 wherein said turnup blow pipe features an upper portion and a lower portion that are removably connected by a releasable joining member.

15. The apparatus of claim 10 wherein the material is paper.

16. The apparatus of claim 10 wherein the means for supplying pressurized air includes a base manifold in communication with said blow pipe.

17. The apparatus of claim 10 further comprising an auxiliary conduit attached to and in communication with said blow pipe and positioned proximate to the web, said auxiliary conduit having an auxiliary slit therethrough so that an additional stream of air blows on the web.

* * * * *